US006343885B1

(12) United States Patent
Heyne

(10) Patent No.: US 6,343,885 B1
(45) Date of Patent: Feb. 5, 2002

(54) WRITING INSTRUMENT WITH HAND GRIP

(76) Inventor: David G. Heyne, 17160 Carranza Dr., San Diego, CA (US) 92127

( * ) Notice: Subject to any disclaimer, the term of this patent is extended or adjusted under 35 U.S.C. 154(b) by 0 days.

(21) Appl. No.: 09/664,897

(22) Filed: Sep. 19, 2000

(51) Int. Cl.[7] ..... A46B 11/00

(52) U.S. Cl. ..... 401/48; 401/6; 16/430; 16/441

(58) Field of Search ..... 401/48, 6, 88, 401/95, 89, 131; 16/430, 441, 111.1, 426, 427, 433

(56) References Cited

U.S. PATENT DOCUMENTS

| | | | | |
|---|---|---|---|---|
| 1,395,793 A | * | 11/1921 | Broschart | 401/6 |
| 1,438,114 A | * | 12/1922 | Hume | 401/6 |
| 1,647,536 A | * | 11/1927 | Miller | 401/6 |
| 1,868,441 A | * | 7/1932 | Colfelt | 401/6 |
| 2,449,575 A | * | 9/1948 | Wilhelm | 16/430 |
| 5,017,034 A | | 5/1991 | Stary et al. | |
| D359,508 S | | 6/1995 | Debbas | |
| 5,468,083 A | | 11/1995 | Chesar | |
| 5,470,162 A | | 11/1995 | Rubin | |
| 5,564,849 A | | 10/1996 | Greer, Jr. | |
| 5,626,430 A | | 5/1997 | Bistrack | |
| 5,785,443 A | | 7/1998 | Rubin | |
| 5,853,210 A | | 12/1998 | Robinson | |

* cited by examiner

*Primary Examiner*—David J. Walczak
(74) *Attorney, Agent, or Firm*—Brown, Martin, Haller & McClain LLP

(57) ABSTRACT

A hand-held implement such as a writing instrument has a body of compressible material having a smoothly rounded, bulbous upper end portion and a lower end portion having an end face with an opening. The lower end portion is inwardly tapered along at least part of its length from the upper end portion towards the end face. A tool such as a pen or pencil is mounted in the body and has a working end projecting from the end face of the lower end portion. A user gripping the body with the base of the index finger engaging an end area of the upper end portion of the body can apply pressure for operating the tool using the palm of the hand at the base of the index finger.

7 Claims, 1 Drawing Sheet

WRITING INSTRUMENT WITH HAND GRIP

BACKGROUND OF THE INVENTION

The present invention relates to writing instruments and other hand-held implements which are held in the hand and manipulated to perform activities, and is particularly concerned with hand-held writing instruments such as pens and pencils.

Pens and pencils typically have a relatively long and thin shaft with a pencil or pen point at one end, and must be gripped by the user's thumb and first two fingers in order to write. This requires a degree of finger dexterity and mobility, and certain individuals can find it difficult or even painful to grip such a small, elongate shaft with their fingers. Such individuals include small children, as well as adults with motor skill disabilities, injuries to the hand, or individuals suffering from various diseases such as arthritis of the hand, carpal tunnel or other types of inflammation of the finger joints. Finger dexterity and mobility may also be limited when individuals wear gloves.

Because of the difficulties encountered by some individuals in gripping a conventional writing instrument, various gripping devices have been proposed in the past to improve the comfort of such individuals and make it easier for them to write. One such device is described in U.S. Pat. No. 5,626,430 of Bistrack. This device comprises a holder for a pen or pencil, which has a through bore through which the writing instrument extends, and which is formed of a compressible material. The device has an upper, oval shaped palm rest, and upper and lower finger shelves on which the fingers can be rested. The device is designed to be gripped by the entire hand, with positions for supporting the palm and all the fingers, so that the pen or pencil extends transversely through the opening formed by the gripping hand. This device still may be difficult to maneuver in order to apply sufficient writing pressure in a downwards direction.

U.S. Pat. No. 5,470,162 of Rubin describes an ergonomic hand-held implement such as a writing instrument. The device has a pen or pencil point at one end, and is gripped in a similar manner to a pencil, but has extended, concave side surfaces which engage the thumb and fingers of a user. This increases the finger area over which pressure is applied, spreading the load and producing less friction and pressure on small contact areas as is typical with conventional pens and pencils. This invention is concerned primarily with reducing discomfort for user's without any disease, injury or disability, and does not overcome the problem of difficulty in using the fingers to apply writing pressure.

SUMMARY OF THE INVENTION

It is an object of the present invention to provide a new and improved hand-held writing instrument or other implement which can be used more easily by individuals with limited finger mobility.

According to the present invention, a hand-held implement is provided, which comprises a hand grip body having a rounded, bulbous upper end portion and lower end portion which is inwardly tapered along at least part of its length, the lower end portion having an end face with an opening, the upper end portion having an end area facing in the opposite direction to the end face for application of pressure by the user's palm at the base of the user's index finger, and a tool mounted in the body and having a working end projecting from the end face of the lower end portion of the body.

In one embodiment, the implement is a writing instrument and the tool is a pen or pencil. The end area of the body may be flattened for easier application of pressure. The body may be hollow and have an internal cavity, with an ink cartridge or pencil lead extending into the body and the pencil or pen point extending out of the end face of the lower end portion of the body. The dimensions of the body are predetermined such that it fits comfortably within the user's palm with the end area engaging the palm at the base of the user's index finger, and the thumb and fingers loosely engaging around the body. The overall length of the implement is such that the pen or pencil point projects from the ends of the fingers for engagement with a paper surface on which the user wishes to write. Writing can then be done by application of pressure by the palm of the hand, without having to grip and apply significant pressure with the fingers.

This device will be easier to use for writing by individuals such as young children, and people with hand injuries or diseases causing pain or limited mobility of the fingers. It will also make writing easier for individuals wearing gloves, either outdoors or for working. Such individuals will find it much easier to apply writing pressure using the palm of their hand at the base of the index finger, with the thumb and fingers used only to loosely grip and guide the implement. The implement will be provided with bodies of various different sizes for use by individuals with different size hands. The device considerably reduces the amount of pressure to be applied by the thumb and fingers in writing or performing other tasks using hand-held tools.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

The drawings illustrate a hand-held writing implement 10 according to one embodiment of the present invention. Although the implement 10 is a writing instrument in the illustrated embodiment, it will be understood that the implement may alternatively be used for other types of hand-held tools or instruments, such as paint brushes, cosmetic brushes, screwdrivers, computer pointing devices, and the like.

Figure 1:
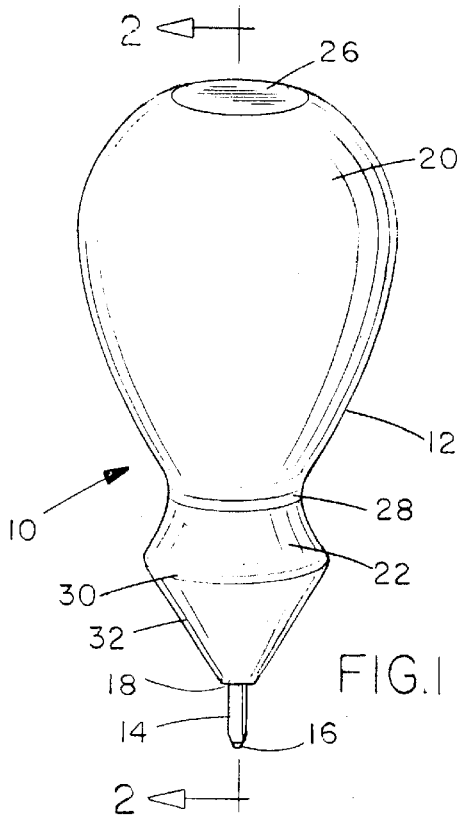
FIG. 1 is a perspective view of the writing instrument, according to an exemplary embodiment of the invention.
Figure 2:
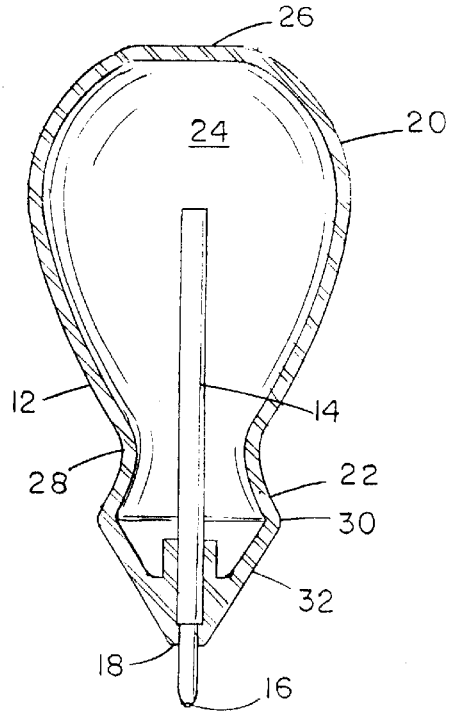
FIG. 2 is a sectional view taken on line 2—2 of FIG. 1.

The writing implement 10 basically comprises a gripping body 12 and a pen or pencil 14 mounted in the body and having a writing point 16 projecting from one end 18 of the body. The body 12 has an upper, rounded or bulbous gripping portion 20 which is of uniform, generally ovoid or egg-shape, and a lower portion 22 extending from the upper portion to the end face 18 from which the writing point 16 projects. In the exemplary embodiment, at least the upper portion of the body is of a compressible or flexible material such as rubber, plastic, foam rubber, or the like. However, it may alternatively be made of a more rigid material such as hard plastic, metal, or other such materials. It may be a hollow body having an internal cavity 24, as illustrated in FIG. 2, or it may be of solid construction with a bore extending inwardly from end face 18 for receiving the shaft of the pencil or pen. The pen or pencil may be removably mounted so that it can be replaced as necessary.

The body in the illustrated example has a flat upper end area 26 for application of writing pressure, with the remainder of the upper portion being smoothly and symmetrically rounded and of overall egg-like shape. The lower end portion of the body then tapers inwardly to neck 28, and flares outwardly to rim 30. The body then has a conically tapered end portion 32 terminating in the end face 18 from which the pen or pencil point projects.

Figure 3:
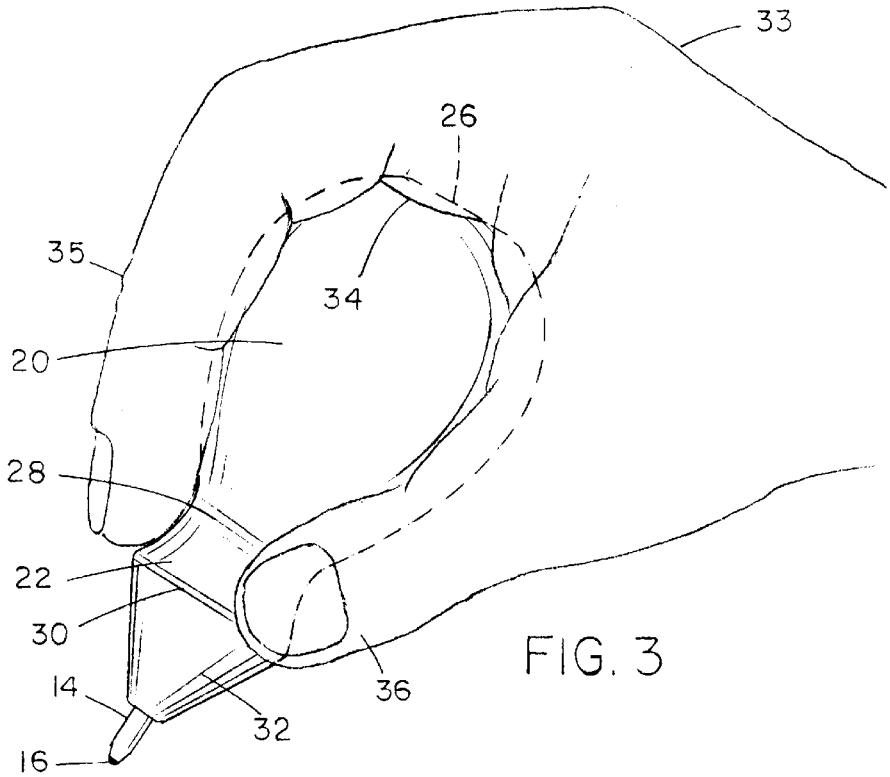
FIG. 3 illustrates the gripping position of the instrument.

FIG. 3 illustrates a hand 33 holding the implement 10 in the proper gripping position. The flattened end area 26 is designed to rest against a portion or pad 34 of the user's palm at the base of the index finger 35. The overall length of the body from end area 26 to the pen or pencil point 16 is arranged such that the pen or pencil point projects from the ends of the user's thumb 36 and finger 35 when the end area 26 is properly positioned as in FIG. 3. The thumb 36, index finger 35, and second finger are curled loosely around the body with the point 16 projecting away from the ends of the finger and thumb and the ends of the fingers resting against the outwardly flared portion of the body. The body 12 will be made in various different sizes suitable for individuals with hands of different sizes.

When the body is held as illustrated in FIG. 3, and the pencil or pen point 16 is applied to a writing surface, the user can readily apply writing pressure with the pad 34 at the base of their index finger pushing against the flattened end area 26 of the body. The thumb and fingers are used merely to loosely guide the device in writing, and do not need to apply any significant amount of pressure in order to write. This considerably reduces or even eliminates the finger pressure required to operate the device, since most or all of the writing pressure is applied by the palm of the hand, specifically by the pad at the base of the index finger. Even individuals with missing or injured fingers, or illnesses such as arthritis of the finger joints, will be able to apply enough writing pressure at the palm of their hand in order to write checks and perform other necessary writing tasks. Individuals wearing gloves will also be able to write more easily using writing implement 10. The instrument 10 is suitable for use by either right or left-handed individuals.

Although an exemplary embodiment of the invention has been described above by way of example only, it will be understood by those skilled in the field that modifications may be made to the disclosed embodiment without departing from the scope of the invention, which is defined by the appended claims.

I claim:

1. A hand-held implement, comprising:

a hand grip body having a smoothly rounded, bulbous upper end portion having a first end area facing in a first direction, and a lower end portion having a second end face with an opening facing in a direction opposite to said first direction, the upper end portion being generally egg-shaped, the lower end portion being inwardly tapered along at least part of its length up to the second end face, the first end area defining an area upon which only the portion of a user's palm at the base of the user's index finger contacts when the device is in use; and a tool mounted in the body and having a working end projecting from the second end face, whereby a user gripping the body between the user's thumb and fingers with the base of the index finger engaging the end area can apply pressure for operating the tool using the portion of the palm of the hand which engages the end area;

the tool comprising a writing device.

2. The implement as claimed in claim 1, wherein the body has an internal cavity projecting inwardly from said end face and the writing device has a shaft mounted in said body cavity and a writing point projecting out of said end face.

3. The implement as claimed in claim 1, wherein the end area of the body is flattened.

4. The implement as claimed in claim 1, wherein the body is of compressible material.

5. The implement as claimed in claim 1, wherein the hand grip body is hollow and has a peripheral wall and an internal chamber, to tool working end being secured in the lower end portion of said body and having a shaft projecting into said chamber and spaced from the peripheral wall of said chamber.

6. The implement as claimed in claim 1, wherein the lower end portion has a first, outwardly tapering part extending from said egg-shaped upper portion, said outwardly tapering part terminating in an annular peripheral rim, and a second, inwardly tapering part tapering inwardly from said rim to said second end face, the outwardly tapering part and rim comprising a support ledge for resting of a user's thumb and fingers when gripping the implement.

7. A hand-held implement, comprising:

a hand grip body having a smoothly rounded, bulbous upper end portion having a first end area facing in a first direction, and a lower end portion having a second end face with an opening facing in a direction opposite to said first direction, the upper end portion extending over more than half of the length of the body and having an inwardly tapering part extending up to said lower end portion;

a tool comprising a writing implement mounted in the body and having a working end projection from the second end face, whereby a user gripping the body between the user's thumb and fingers with the base of the index finger engaging the end area can apply pressure for operation the tool using the portion of the palm of the hand which engages the end area; and the lower end portion having a first, outwardly tapering part extending from said inwardly tapering part of said upper portion, said outwardly tapering part termination in an annular peripheral rim, and a second, inwardly tapering part tapering inwardly from said rim to said second end face, the outwardly tapering part and a rim comprising a support ledge for resting of a user's thumb and fingers when gripping the implement.

* * * * *